US007921589B1

(12) United States Patent
Baker

(10) Patent No.: US 7,921,589 B1
(45) Date of Patent: Apr. 12, 2011

(54) SINGLE ACTION FIREARM ACTION

(75) Inventor: Robert Baker, Freedom, WY (US)

(73) Assignee: Freedom Arms, Freedom, WY (US)

( * ) Notice: Subject to any disclaimer, the term of this patent is extended or adjusted under 35 U.S.C. 154(b) by 469 days.

(21) Appl. No.: 12/128,407

(22) Filed: May 28, 2008

(51) Int. Cl.
*F41A 17/30* (2006.01)

(52) U.S. Cl. ..... 42/70.08

(58) Field of Classification Search ..... 42/70.08, 42/70.01, 70.07, 70.04, 70.05, 70.06, 63–66, 42/44, 45

See application file for complete search history.

(56) References Cited

U.S. PATENT DOCUMENTS 875,469 A * 12/1907 Tambour ..... 42/66
3,803,741 A * 4/1974 Ducommun ..... 42/66
3,962,609 A * 6/1976 Chaudhuri ..... 361/836
3,962,809 A * 6/1976 Lee ..... 42/66
3,988,848 A * 11/1976 Chatigny ..... 42/70.08
4,439,942 A * 4/1984 M.sup.a Gabilondo ..... 42/66
4,621,445 A * 11/1986 Rohm ..... 42/66
5,560,132 A * 10/1996 Merlino ..... 42/66
5,673,506 A * 10/1997 Pantuso et al. ..... 42/67
5,680,722 A * 10/1997 French et al. ..... 42/69.03
5,724,759 A * 3/1998 Kilham ..... 42/66
6,347,473 B1 * 2/2002 Buffoli ..... 42/66
6,698,125 B2 * 3/2004 Baker ..... 42/66
2005/0028420 A1 * 2/2005 Rossi ..... 42/70.08

* cited by examiner

*Primary Examiner* — Bret Hayes
*Assistant Examiner* — Reginald Tillman, Jr.
(74) *Attorney, Agent, or Firm* — Kirton & McConkie; Michael F. Krieger

(57) ABSTRACT

A new firearm action is described. The action may be adapted to single-shot handguns and rifles, lever-action firearms, single-action revolvers or to other types of firearms. The new firearm action provides a safety device in a firearm that does not affect the trigger pull when firing the firearm and maintains a durable and reliable action. The trigger cannot be pulled when it is in the safe position, and when the action is in the safe position, the hammer cannot contact the firing pin. The action does not allow the barrel of the firearm to be opened when the hammer is in the cocked position. It also keeps the barrel from being closed if the hammer is cocked when the barrel is in the open position. The hammer cannot contact the firing pin if the top slide is in the retracted position.

19 Claims, 5 Drawing Sheets

SINGLE ACTION FIREARM ACTION

BACKGROUND OF THE INVENTION

1. Field of the Invention

The present invention relates to a novel firearm action, and more particularly to a single action firearm action that incorporates improved safety features.

2. Background and Related Art

It is generally desirable to assist a firearm user in carrying and using a firearm in a safe manner. Therefore, numerous safety mechanisms have been implemented in various types of firearms to attempt to improve the safety of firearms generally. Regardless of the safety features implemented in a firearm, users still need to familiarize themselves with the firearm before using it. They still need to carry the firearm in a proper manner. They still need to avoid using the firearm when under the influence of mind altering substances like alcohol and drugs. In short, even with safety features incorporated into a firearm, the firearm still has inherent dangers to users and to those around the users.

Of course, firearms are most dangerous to users and others when rounds are chambered in the firing position of the firearms, and especially when the firearms are in fully-cocked positions. The dangers inherent in such situations include the danger of an inadvertent firing condition when the firearm is directed in an unsafe direction. Inadvertent firing conditions include an inadvertent pull of the trigger or other release of a cocked hammer when a round is not fully chambered or a breech is open. Other inadvertent firing conditions may occur when the hammer is in a non-cocked position and may include situations where a non-cocked hammer is permitted or caused to strike a firing pin with sufficient force to cause firing of a chambered round. This may occur, for example, in some firearms when the firearm is dropped or when some object strikes the hammer from behind with sufficient force.

Some safety mechanisms may be designed to prevent inadvertent firing conditions of the type described above. However, many existing safety mechanisms may affect performance of the firearms into which they are incorporated, such as by affecting the trigger pull. As is commonly known to firearm enthusiasts, a poor trigger pull has a negative effect on the potential accuracy of the firearm. Other safety mechanisms may adversely affect reliability and durability of the firearm action.

BRIEF SUMMARY OF THE INVENTION

Implementation of the invention provides a new firearm action. The firearm action is described in relation to a break-open single-shot firearm, such as a handgun. It is anticipated, however, that the action described herein may be adapted to single-shot handguns and rifles, lever-action firearms, and potentially single-action revolvers. It may also be applied to other types of firearms not specifically mentioned herein.

The new firearm action provides a safety device in a firearm that does not affect the trigger pull when firing the firearm and maintains a durable and reliable action. The trigger cannot be pulled when it is in the safe position, and when the action is in the safe position, the hammer cannot contact the firing pin. The action does not allow the barrel of the firearm to be opened when the hammer is in the cocked position. It also keeps the barrel from being closed if the hammer is cocked when the barrel is in the open position. The hammer cannot contact the firing pin if the top slide is in the retracted position.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
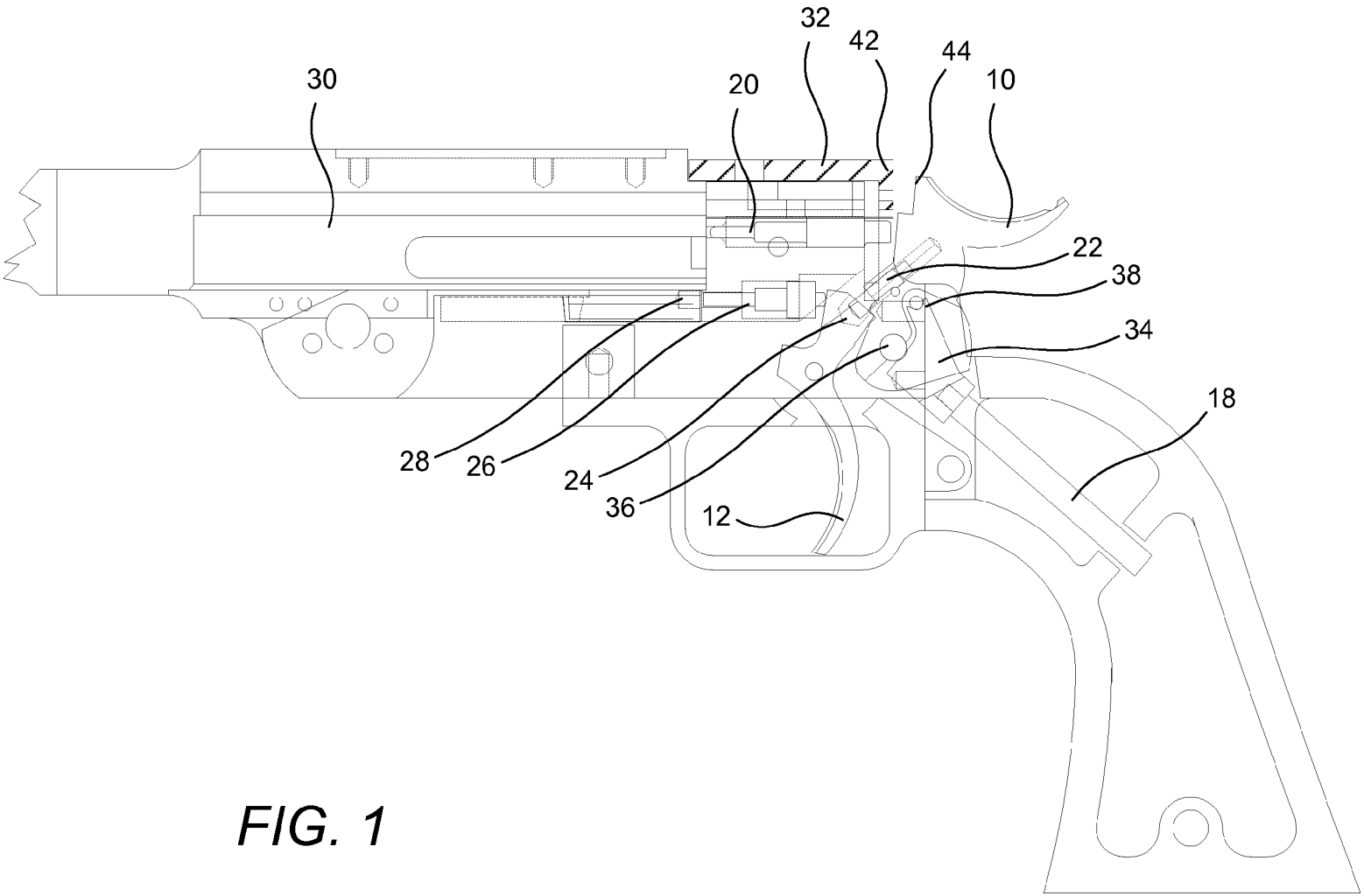
FIG. 1 shows a plan view of a single shot firearm in the safety position.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide a new firearm action. The new firearm action provides a safety device in a firearm that does not affect the trigger pull when firing the firearm and maintains a durable and reliable action. The trigger cannot be pulled when it is in the safe position, and when the action is in the safe position, the hammer cannot contact the firing pin. The action does not allow the barrel of the firearm to be opened when the hammer is in the cocked position. It also keeps the barrel from being closed if the hammer is cocked when the barrel is in the open position. The hammer cannot contact the firing pin if the top slide is in the retracted position.

FIGS. 1-5 depict views of a break-open single-shot firearm. It is anticipated, however, that the action described herein may be adapted to single-shot handguns and rifles, lever-action firearms, and potentially single-action revolvers. It may also be applied to other types of firearms not specifically mentioned herein.

As may be seen from the Figures, the action includes a hammer 10 and a trigger 12. The trigger 12 includes a trigger sear 14 and the hammer 10 includes a corresponding hammer sear 16, whereby when the hammer 10 is moved to its fully-cocked position, the trigger sear 14 and the hammer sear 16 engage to hold the hammer 10 in the fully-cocked position, as is illustrated in more detail in FIG. 5. The action also includes a mainspring assembly 18 (the spring of the mainspring assembly 18 is not shown in the Figures for clarity) and a firing pin 20 (the spring of the firing pin 20 is also not shown).

The action also includes safety features that improve the safety of use of a firearm incorporating the action. The hammer 10 includes a safety plunger 22 slidingly secured within a safety plunger channel of the hammer 10, such as by a pin, and adapted to be received within a trigger relief 24 of the trigger 12. A trigger plunger 26 is slidingly contained within a trigger plunger channel forward of the upper portion of the trigger 12 and is adapted to be engaged by the trigger 12 and to be received within a barrel relief 28 of a barrel 30 of the firearm. The improved safety provided by these features and by other safety features of the action will be described in detail below, as operation of the action is described.

FIG. 1 shows the action in the safety position. In this position, the safety plunger 22 is fully extended within the trigger relief 24, preventing pulling of the trigger 12. The safety plunger 22 is biased into its fully-extended position by a safety plunger spring (not shown). In the safety position, the trigger plunger 26 is biased into its fully-withdrawn position (such as by a trigger plunger spring, not shown), whereby it does not engage the barrel relief 28, and the barrel 30 may be opened for loading, such as by sliding a top slide 32 rearward to unlock the barrel 30. The barrel 30 may then be tipped forward to unload/load the chamber, after which the barrel 30 may be closed and locked by the top slide 32. When loaded, the firearm is ready to be cocked and fired.

Starting from the safety position shown in FIG. 1, the hammer 10 is drawn rearward toward its fully-cocked position. As the hammer 10 is drawn rearward, the front lower portion of the hammer 10 pushes the top of the trigger 12 forward which positions the top rear portion of the trigger 12 (i.e. the portion just rearward of the trigger relief 24) to be aligned with the safety plunger 22 which has been rotated out of the trigger relief 24 area in the trigger 12. The top of the trigger 12 also pushes the trigger plunger 26 forward into the barrel relief 28 in the barrel 30 which keeps the barrel 30 from being opened. This improves the safety of the firearm, as the barrel 30 cannot be opened when the hammer 10 is fully cocked.

In the event that the barrel 30 of the firearm is opened, such as for loading/unloading, and the hammer 10 is cocked while the barrel 30 is in the open position, the front lower portion of the hammer 10 pushes the top of the trigger 12 forward, just as if the barrel 30 were closed. As the top of the trigger 12 is pushed forward, it pushes the trigger plunger 26 forward as before, but because the barrel 30 is open, the trigger plunger pushes forward below the opened breech end of the barrel 30. In this way, the trigger plunger 26 prevents the barrel 30 from being closed when the hammer 10 is cocked, reducing the risk of an accidental firing upon closing the barrel 30. As may also be appreciated, if the barrel 30 is only partially opened and someone attempts to cock the hammer 10, the trigger plunger 26 will encounter the solid breech end of the barrel 30, thereby preventing the hammer from being cocked.

Figure 2:
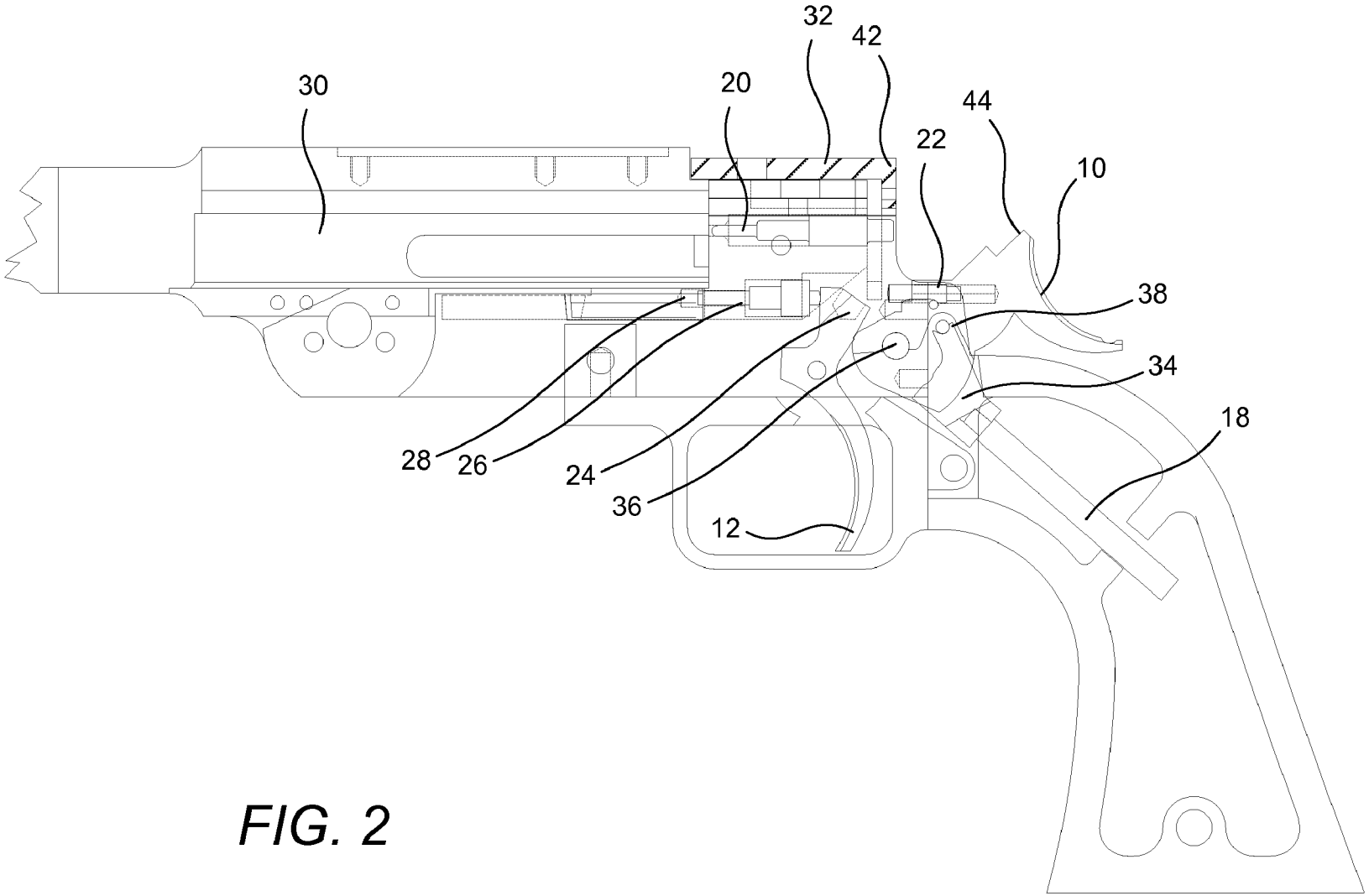
FIG. 2 shows a plan view of the single shot firearm in the fully-cocked position.
Figure 5:
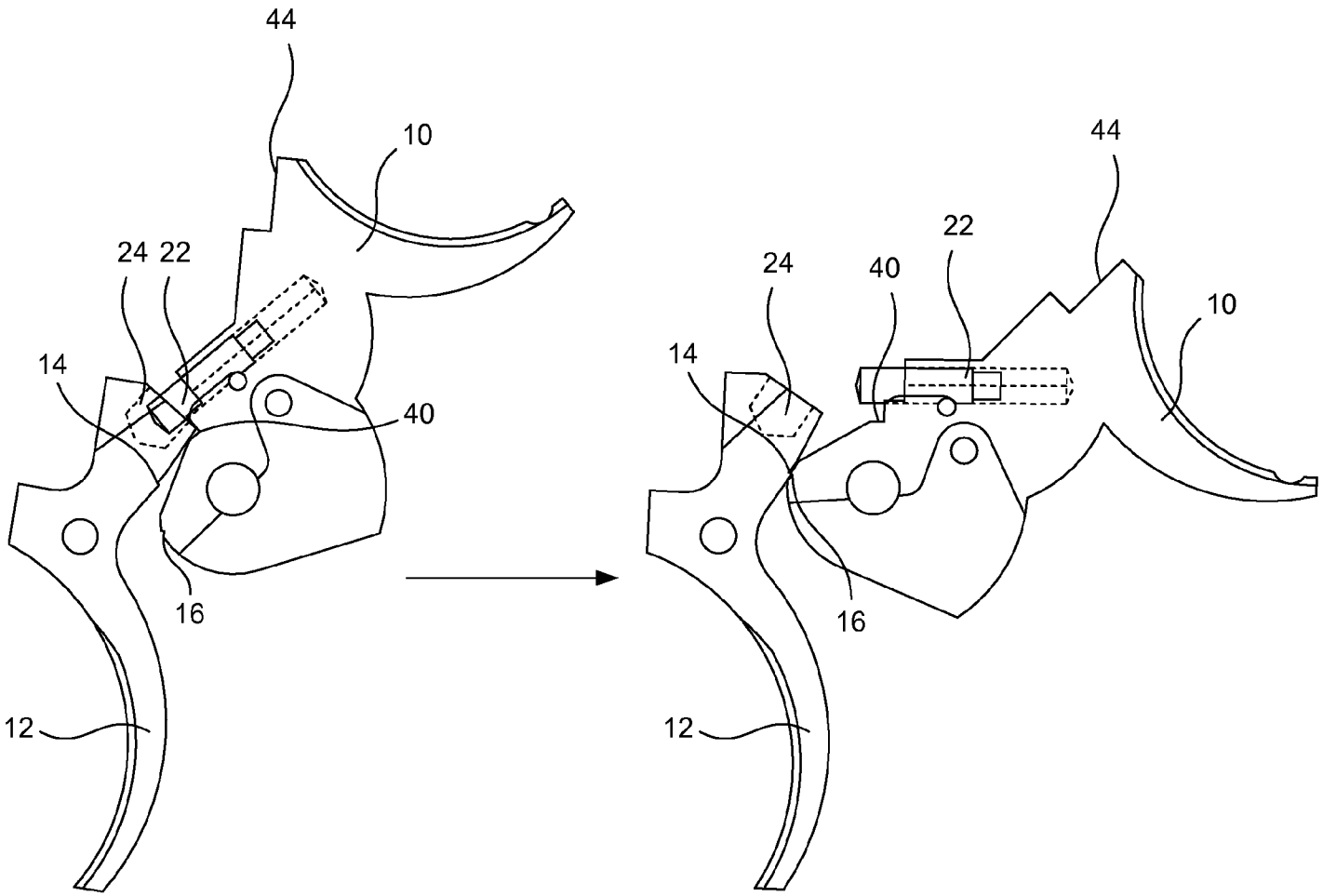
FIG. 5 shows an exploded plan view of the hammer and trigger in the safety and fully-cocked positions.

When the barrel 30 is properly closed and the hammer 10 reaches its fully-cocked position, the trigger sear 14 engages the hammer sear 16 to hold the hammer 10 in the fully-cocked position (see FIG. 5). FIG. 2 shows the firearm with the hammer 10 in the fully-cocked position. As stated above, the top rear portion of the trigger 12 just behind the trigger relief 24 is now aligned to depress the safety plunger 22 when the hammer 10 rotates forward after the trigger 12 is pulled.

When the trigger 12 is pulled, the trigger plunger 26 is held forward into the barrel relief 28 in the barrel 30 by the upper front portion of the trigger 12. Thus, the barrel 30 cannot be opened until after the firearm has been fired or the hammer 10 has been lowered and the trigger 12 has been released. When the trigger 12 is pulled, the trigger sear 14 and the hammer sear 16 disengage, and the hammer 10 is allowed to rotate forward under pressure from the mainspring assembly 18.

Figure 3:
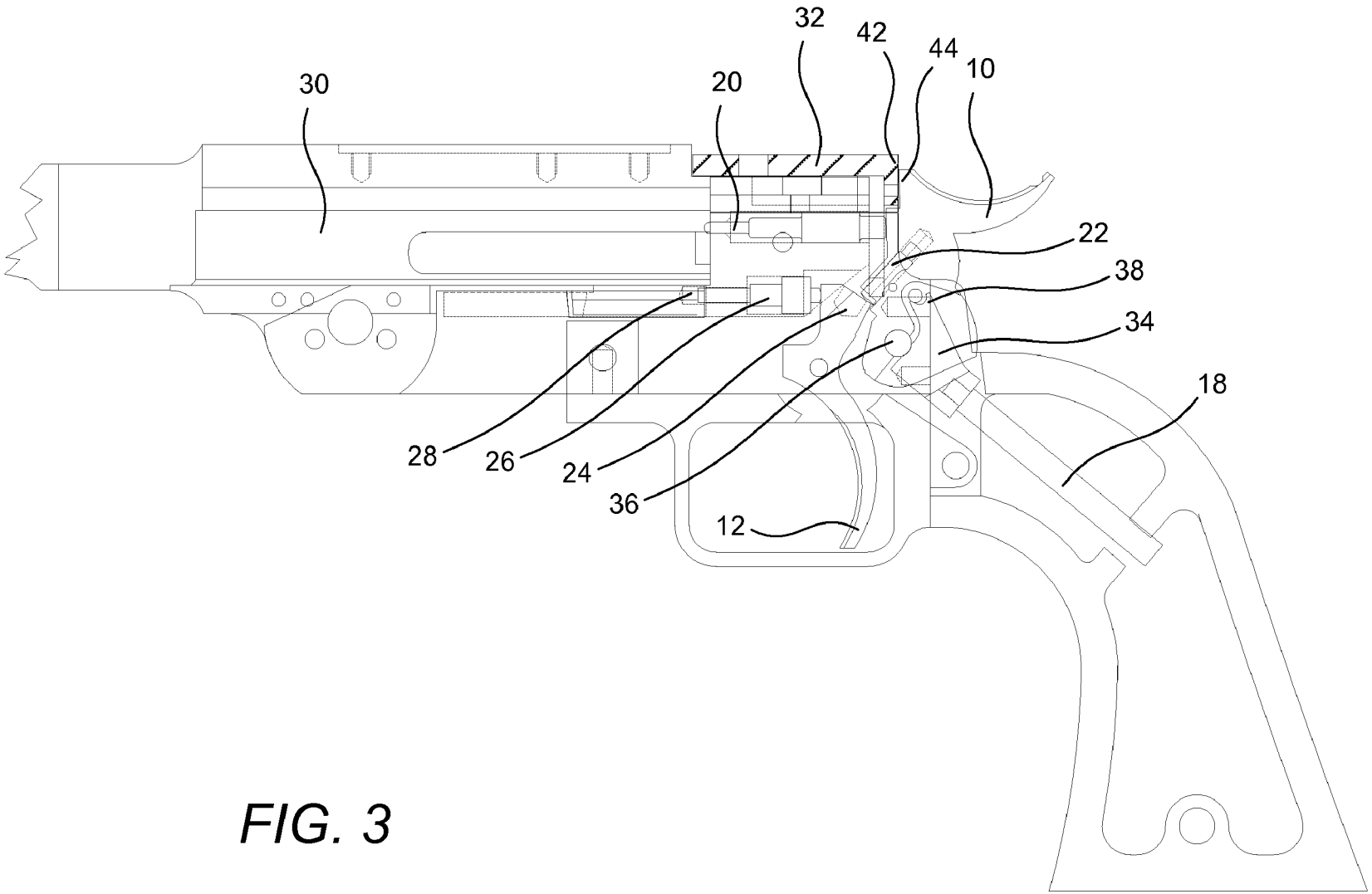
FIG. 3 shows a plan view of the single shot firearm in the fired position.

As the hammer 10 rotates forward, a mainspring assembly shoe 34 engages a hammer axis pin 36 which stops the mainspring assembly 18 from continuing to push the hammer 10 forward. The safety plunger 22 also contacts the top rear portion of the trigger 12 which pushes the safety plunger 22 into the hammer 10 (i.e. more fully within the safety plunger channel and against the biasing force of the safety plunger spring, not shown). Once the mainspring assembly 18 stops pushing the hammer 10 forward, the inertia of the hammer 10 continues to carry the hammer 10 forward against the spring pressure of the safety plunger 22 and the firing pin 20. The spring pressures of the mainspring assembly 18, the firing pin 20 and the safety plunger 22 are balanced to allow the inertia of the hammer 10 to pass enough force/momentum to the firing pin 20 to fire a cartridge. FIG. 3 shows the firearm at the point of maximum forward travel of the hammer 10 during firing, although in some embodiments, the firing pin 20 may travel farther forward to fire the chambered round.

Once the cartridge fires, any or all of the combined forces of the cartridge firing, the firing pin spring (not shown) and the safety plunger spring (not shown) will push the hammer 10 back against a push point 38 of the mainspring assembly shoe 34. This positions the hammer 10 so that when the trigger 12 is released, the top of the trigger 12 can move into a hammer relief 40 (see FIG. 5) cut in the hammer 10 which will block the hammer 10 from moving forward against the firing pin 20. The safety plunger 22 will then automatically extend into the trigger relief 24 in the trigger 12 (due to the spring force on the safety plunger 22), which will keep the trigger 12 from being pulled out of the safety position without the hammer 10 being pulled back/cocked. In other words, the action is thereby returned to the position of FIG. 1.

Figure 4:
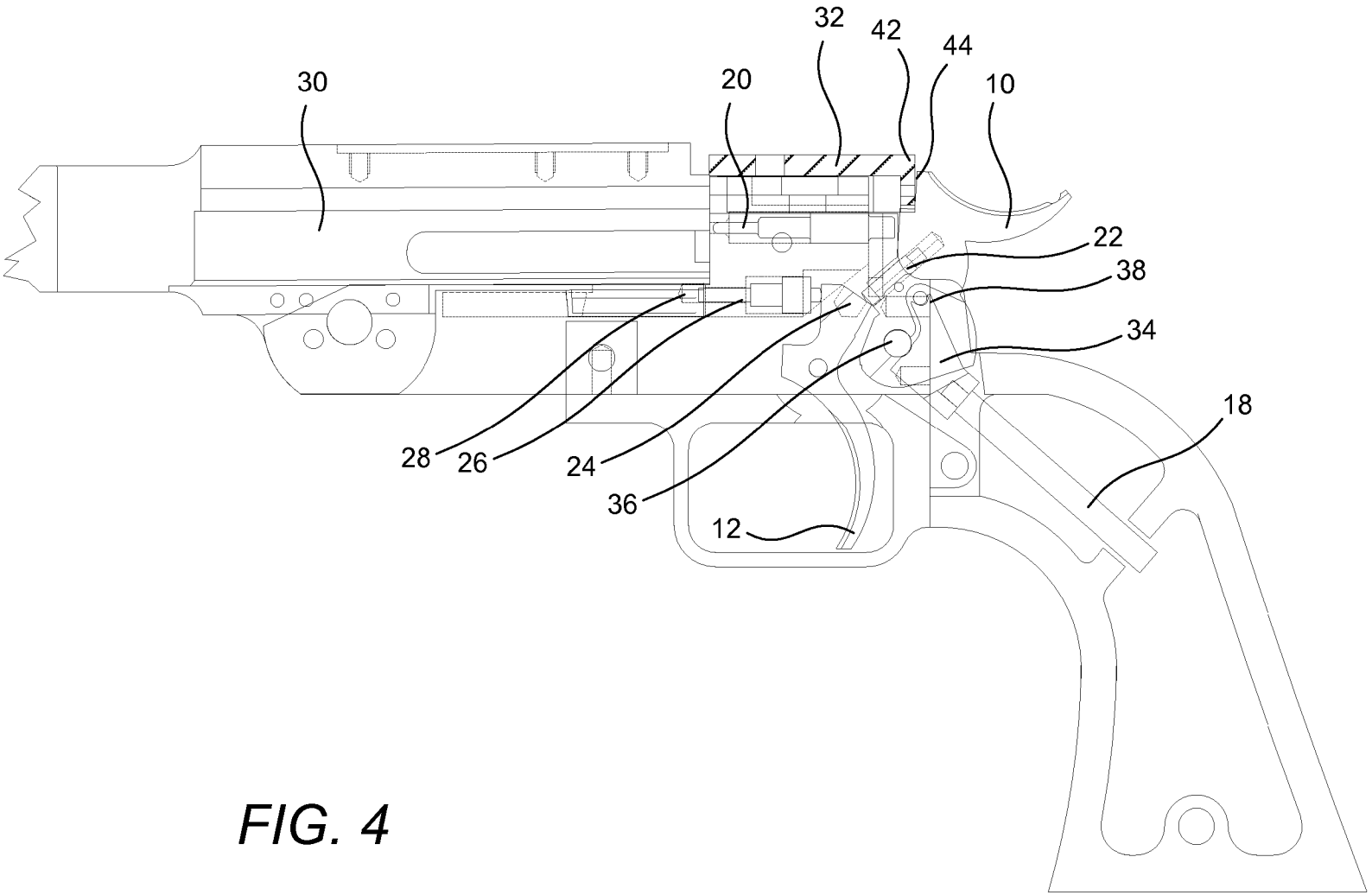
FIG. 4 shows a plan view of the single shot firearm in a position with the trigger pulled and the top slide retracted.

As described above, the firearm may be opened and unloaded/loaded/reloaded when the trigger 12 and hammer 10 are in the safety position of FIG. 1. FIG. 1 shows the top slide 32 in the full forward position which locks the barrel 30 into position so the firearm can be fired. When the top slide 32 is drawn rearward to allow the barrel 30 to tip up for loading or unloading, a back 42 of the top slide 32 contacts a front upper portion 44 of the hammer 10, physically preventing the hammer 10 from contacting the firing pin 20 when the top slide 32 is open, as illustrated in FIG. 4. This feature makes sure the barrel 30 is fully closed and the top slide 32 is at least partially locking the barrel 30 in the closed position before the hammer 10 can contact the firing pin 20. FIG. 4 also illustrates that the barrel 30 may not be opened while the trigger 12 is still pulled after firing, as the trigger 12 still forces the trigger plunger 26 into the barrel relief 28; the trigger plunger 26 further prevents opening the barrel 30 until the trigger 12 is released and returned to the safety position (such as by the force of the trigger plunger spring (not shown)).

Thus, in summary, FIGS. 1-4 show plan views of the single-shot firearm in various states of firing and opening. Particularly, FIG. 1 shows the firearm with the hammer 10 in the safety position where the mainspring assembly 18 (spring not shown) is not pushing forward on the hammer 10 and the hammer 10 is not touching the firing pin 20, which is in its fully-retracted position. The top of the trigger 12 is blocking the hammer 10 from moving toward the firing pin 20 and the safety plunger 22 is extended, under spring pressure (spring not shown), into the trigger relief 24 in the trigger 12 which keeps the trigger 12 from being pulled out of the safety position. Therefore, the trigger 12 is retained within the hammer relief 40 by the safety plunger 22, physically blocking the hammer 10 from moving toward the firing pin 20. Also shown is the trigger plunger 26 biased against the front of the trigger 10 by spring pressure. The spring of the trigger plunger 26 is not shown but is in front of the trigger plunger 26 applying opposing pressure against the frame and trigger plunger 26. With the action in the safety position shown, the front of the trigger plunger 26 is withdrawn into the frame which allows the barrel 30 to be opened and closed. The top slide 32 is shown in the fully forward position which locks the barrel 30 into the closed position.

FIG. 2 shows the hammer 10 in the fully-cocked position with the trigger sear 14 and hammer sear 16 engaged (see FIG. 5) to hold the hammer 10 in the fully-cocked position. In this position the mainspring assembly 18 is applying its full force against the hammer 10. The trigger 12 is biased rearward against the hammer 10 by spring pressure against the trigger plunger 26 as described above. The trigger plunger 26 is also extended forward into the barrel relief 28 in the barrel 30, which keeps the barrel 30 from being opened.

FIG. 3 shows the hammer 10 in the fired position which has forced the firing pin 20 fully forward to fire a cartridge (not shown) in the chamber (not shown). In this position, the safety plunger 22 has been pushed into the safety plunger channel of the hammer 10 by the top of the trigger 12 and the mainspring assembly 18 is not applying any force against the hammer 10. The trigger plunger 26 is still extended forward into the barrel relief 28 in the barrel 30 by the pulled trigger 12 to keep the barrel 30 from being opened.

FIG. 4 demonstrates how the hammer 10 cannot contact the firing pin 20 if the top slide 32 is retracted back to unlock the barrel 30. When the hammer 10 is in the fully-cocked position (as shown in FIG. 2) and the top slide 32 is retracted, the breech end of the barrel 30 may be allowed to move up slightly until the trigger plunger 26 stops it; however, if the trigger 12 is pulled, the hammer 10 will move forward under pressure from the mainspring assembly 18 but instead of hitting the firing pin 20, the hammer 10 (specifically the front upper portion 44) will hit the back 42 of the top slide 32 as shown in FIG. 4. With the front of the top slide 32 against the breech end of the barrel 30 the hammer 10 is thus blocked from hitting the firing pin 20, further improving the safety of the firearm.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A firearm action comprising:

a hammer movably connected to a firearm whereby the hammer can strike a firing pin of the firearm to fire the firearm, the hammer comprising a safety plunger slidingly secured within a safety plunger channel of the hammer; and a trigger movably connected to the firearm whereby the trigger can release the hammer and allow the hammer to strike the firing pin, the trigger comprising a trigger relief adapted to receive the safety plunger when the firearm action is in a safety position, wherein the safety plunger of the hammer is biased outward of the safety plunger channel to engage and secure the trigger by entering the trigger relief.

2. The firearm action of claim 1, wherein the trigger comprises a portion rearward of the trigger relief that is higher than the trigger relief, whereby when the hammer is in a firing position the portion rearward of the trigger relief engages the safety plunger and pushes the safety plunger more fully within the safety plunger channel.

3. The firearm action of claim 1, wherein the hammer further comprises a hammer relief configured to engage a portion of the trigger when the firearm action is in the safety position, whereby the hammer is physically prevented by the portion of the trigger from contacting the firing pin until the hammer is cocked.

4. The firearm action of claim 1, wherein the firearm action is a single-action-type action.

5. The firearm action of claim 1, further comprising:

a trigger plunger slidingly contained within a trigger plunger channel of the firearm proximate the trigger; and a barrel relief adapted to receive a forward portion of the trigger plunger;

whereby when the trigger is in a fully-depressed position and the barrel is closed, the position of the trigger forces the trigger plunger forward into the barrel relief, thereby keeping the barrel from fully opening.

6. The firearm action of claim 5, wherein when the trigger is in a fully-depressed position and the barrel is opened, the position of the trigger forces the trigger plunger forward below a breech end of the barrel, thereby physically preventing the barrel from being closed.

7. The firearm action of claim 5, wherein the hammer further comprises a portion that, when the hammer is in a fully-cocked position, engages and forces the trigger into a position that forces the trigger plunger sufficiently forward to engage the barrel relief and keep the barrel from fully opening.

8. The firearm action of claim 5, further comprising a top slide slidingly attached to the firearm that locks the barrel closed, whereby when the top slide is moved backward to open the barrel, a back portion of the top slide engages a front upper portion of the hammer, physically preventing the hammer from striking the firing pin.

9. The firearm action of claim 1, further comprising a top slide slidingly attached to the firearm that locks the barrel closed, whereby when the top slide is moved backward to open the barrel, a back portion of the top slide engages a front upper portion of the hammer, physically preventing the hammer from striking the firing pin.

10. A firearm action comprising:

a hammer movably connected to a firearm whereby the hammer can strike a firing pin of the firearm to fire the firearm;

a trigger movably connected to the firearm whereby the trigger can release the hammer and allow the hammer to strike the firing pin;

a trigger plunger slidingly contained within a trigger plunger channel of the firearm proximate the trigger; and a barrel relief adapted to receive a forward portion of the trigger plunger;

whereby when the trigger is in a fully-depressed position and the barrel is closed, the position of the trigger forces the trigger plunger forward into the barrel relief, thereby keeping the barrel from fully opening.

11. The firearm action of claim 10, wherein the hammer comprises a safety plunger, and wherein the trigger comprises a trigger relief adapted to receive the trigger plunger when the firearm action is in a safety position.

12. The firearm action of claim 11, wherein the safety plunger of the hammer is slidingly secured within a safety plunger channel of the hammer, and is biased outward of the safety plunger channel to engage and secure the trigger by entering the trigger relief.

13. The firearm action of claim 12, wherein the trigger comprises a portion rearward of the trigger relief that is higher than the trigger relief, whereby when the hammer is in a firing position the portion rearward of the trigger relief engages the safety plunger and pushes the safety plunger more fully within the safety plunger channel.

14. The firearm action of claim 11, wherein the hammer further comprises a hammer relief configured to engage a portion of the trigger when the firearm action is in the safety position, whereby the hammer is physically prevented by the portion of the trigger from contacting the firing pin until the hammer is cocked.

15. The firearm action of claim 10, wherein the hammer further comprises a portion that, when the hammer is in a fully-cocked position, engages and forces the trigger into a position that forces the trigger plunger sufficiently forward to engage the barrel relief and keep the barrel from fully opening.

16. The firearm action of claim 10, further comprising a top slide slidingly attached to the firearm that locks the barrel closed, whereby when the top slide is moved backward to open the barrel, a back portion of the top slide engages a front upper portion of the hammer, physically preventing the hammer from striking the firing pin.

17. A firearm action comprising:

a hammer movably connected to a firearm whereby the hammer can strike a firing pin of the firearm to fire the firearm, the hammer comprising a safety plunger;

a trigger movably connected to the firearm whereby the trigger can release the hammer and allow the hammer to strike the firing pin, the trigger comprising a trigger relief adapted to receive the safety plunger when the firearm action is in the safety position;

a trigger plunger slidingly contained within a trigger plunger channel of the firearm proximate the trigger; and a barrel relief adapted to receive a forward portion of the trigger plunger, whereby when the trigger is in a fully-depressed position and the barrel is closed, the position of the trigger forces the trigger plunger forward into the barrel relief, thereby locking the barrel in a closed position; and a top slide slidingly attached to the firearm that locks the barrel closed, whereby when the top slide is moved backward to open the barrel, a back portion of the top slide engages a front upper portion of the hammer, physically preventing the hammer from striking the firing pin.

18. The firearm action of claim 17, wherein the safety plunger is slidingly secured within a safety plunger channel of the hammer and is biased outward of the safety plunger channel to engage and secure the trigger by entering the trigger relief.

19. The firearm action of claim 18, wherein the hammer further comprises a portion that, when the hammer is in a fully-cocked position, engages and forces the trigger into a position that forces the trigger plunger sufficiently forward to engage the barrel relief and keep the barrel from fully opening.

* * * * *